US005255598A

United States Patent [19]

van Sas et al.

[11] Patent Number: 5,255,598

[45] Date of Patent: Oct. 26, 1993

[54] SCREEN PRINTING DEVICE WITH CONTINUOUS REGISTERING OF ROTATING STENCILS

[75] Inventors: Carolus T. J. A. van Sas, Helmond; Franciscus J. J. van Akkeren, Stramproy; Henricus J. Teeuwen, Weert; Robert J. van den Berg, Ewijk; Jan H. Nekkers, Gennep, all of Netherlands

[73] Assignee: Stork Brabant B.V., An Boxmeer, Netherlands

[21] Appl. No.: 909,099

[22] Filed: Jul. 2, 1992

[30] Foreign Application Priority Data

Jul. 5, 1991 [NL] Netherlands ..... 9101176

[51] Int. Cl.[5] ..... B41L 13/00

[52] U.S. Cl. ..... 101/118; 101/116; 101/248

[58] Field of Search ..... 101/115, 116, 117, 118, 101/119, 120, 178, 181, 211, 248

[56] References Cited

U.S. PATENT DOCUMENTS

| | | | |
|---|---|---|---|
| 3,998,156 | 12/1976 | Zimmer | 101/115 |
| 4,238,999 | 12/1980 | Giani et al. | 101/116 |
| 4,366,542 | 12/1982 | Anselrode | 101/116 |
| 4,563,947 | 1/1986 | Matsushita et al. | 101/363 |
| 4,690,051 | 9/1987 | Kishine et al. | 101/181 |
| 4,857,745 | 8/1989 | Gough | 101/181 |
| 4,909,143 | 3/1990 | Van den Berg et al. | 101/118 |
| 4,915,516 | 4/1990 | Shimizu et al. | 400/703 |
| 4,932,320 | 6/1990 | Brunetti et al. | 101/181 |
| 5,056,430 | 10/1991 | Bayerlein et al. | 101/181 |

FOREIGN PATENT DOCUMENTS

| | | |
|---|---|---|
| 0396924 | 11/1990 | European Pat. Off. . |
| 8702408 | 5/1989 | Netherlands . |

*Primary Examiner*—Edgar S. Burr
*Assistant Examiner*—Ren Yan
*Attorney, Agent, or Firm*—Bell, Seltzer, Park & Gibson

[57] ABSTRACT

Screen printing device, comprising an endless printing belt on which a web of material can be fixed temporarily, a printing belt drive device, and a number of rotary stencils driven by stencil drive devices, the printing belt drive device being coupled to the stencil drive devices at a predetermined angle presetting thereof for a synchronous movement thereof. The device also has a signal generation device which can produce a signal forming a measure for a displacement of the printing belt. One or more markings are provided on or in the printing belt and can be detected by detectors securely fixed at predetermined intervals. A comparison device compares the signal coming from the signal generation device, during a displacement of a marking on the printing belt from one detector to a next detector, with a predetermined reference signal, following which a correction device adjusts the angle presetting of one or more stencils on the basis of the comparison result of the comparison device.

9 Claims, 2 Drawing Sheets

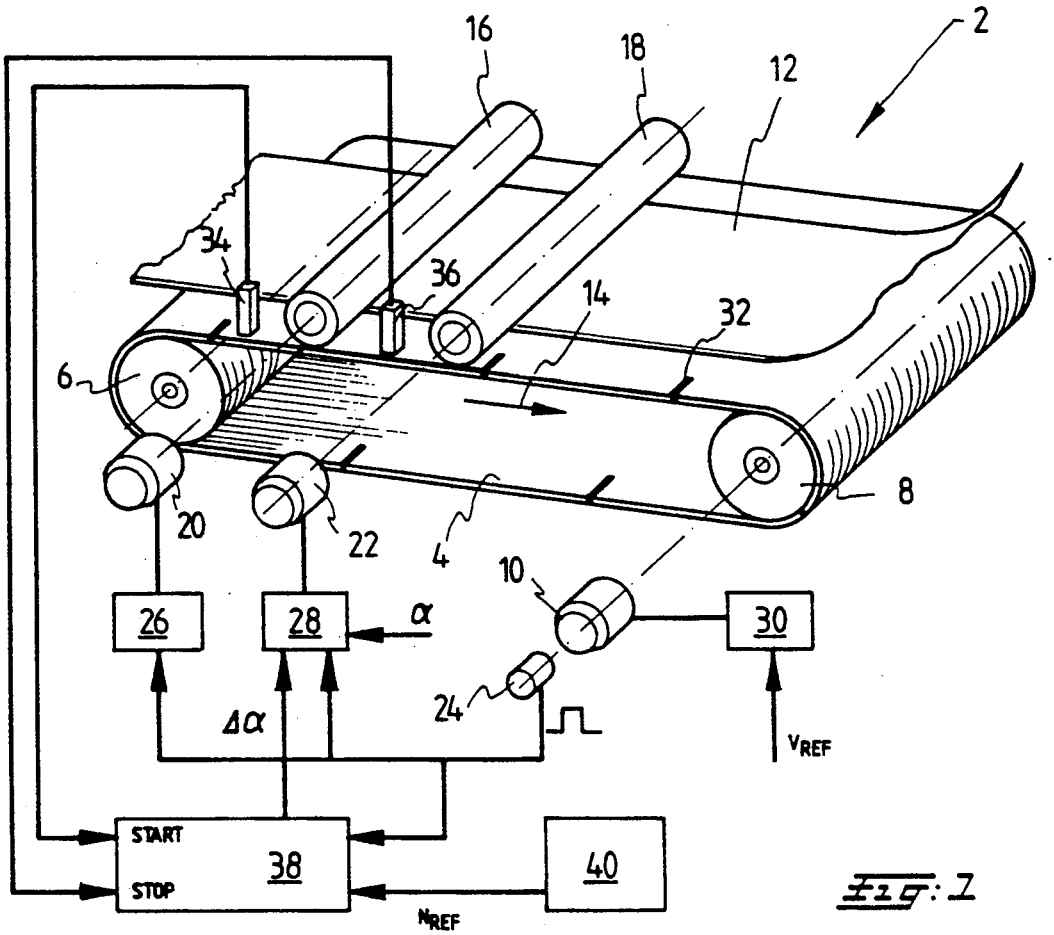
Fig: 1
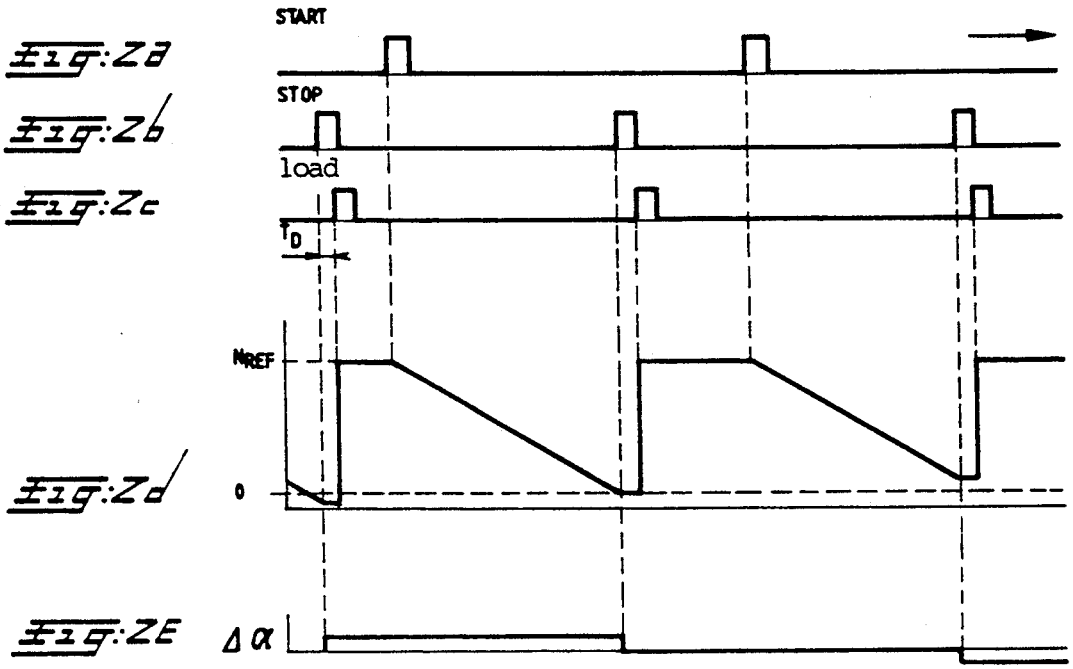

SCREEN PRINTING DEVICE WITH CONTINUOUS REGISTERING OF ROTATING STENCILS

BACKGROUND OF THE INVENTION

This invention relates to a screen printing device for printing a web of material, comprising: an endless printing belt which is guided over a number of rollers supported in a frame, on which printing belt the web of material can be fixed temporarily; a printing belt drive device which is coupled to at least one printing belt drive roller for driving the printing belt; a number of rotary stencils for applying a pattern to the web of material; and stencil drive means which are coupled to each stencil for driving the stencils, the printing belt drive device being coupled to the stencil drive means at a predetermined angle presetting thereof for a synchronous movement thereof.

DISCUSSION OF THE PRIOR ART

A screen printing device as described above is known, for example, from Dutch Patent Application 8,702,408. In this application the drive means for the stencils are mechanically coupled slip-free by means of a stepped alternating drive unit to a motor drive, which also drives a printing belt drive roller.

It is also possible to couple the drive of the stencils other than mechanically to the drive of the printing belt, for example as described in European Patent Application 0,396,924. From the latter publication it is known to couple each stencil to its own electrical drive, while the coupling between the individual stencil drives and between the stencils and the printing belt drive device required for synchronous running of the stencils is achieved by electronic control means.

Both the use of a mechanical coupling between the printing belt drive device and the stencil drive means and the use of an electronically produced coupling between the printing belt drive device and the stencil drive means make a highly accurately synchronised running of printing belt drive roller(s) and stencils achievable.

The various stencils of the screen printing device each serve to apply a specific pattern and/or a specific colour to the web of material to be printed, and for this purpose the stencils must be accurately brought into register prior to the printing process. This is generally carried out by hand with the screen printing device running at low speed. Registering the stencils prior to the printing process does not, however, by any means guarantee that the stencils will be in register at a later stage during the printing process. Various factors can be indicated which cause the stencils to be temporarily or permanently out of register, for example the drive roller wobbling, slipping of the printing belt over the printing belt drive roller, thickness variations in the printing belt over its length, length changes in the printing belt, and temperature variations causing the screen printing machine to increase or decrease in length locally or otherwise. It has therefore been necessary until now to carry out regular checks on the register of the stencils during the printing process by a visual examination of the printed result, and to adjust it if necessary by changing the angle presetting of one or more stencils if a deviation is found. It must be remembered here that for certain applications deviations of 0.0001 m are already inadmissible.

SUMMARY OF THE INVENTION

The object of the invention is to provide a screen printing device by means of which continuous automatic registering of the stencils during the printing process can be achieved, so that once the screen printing device has been registered, it can operate constantly at maximum capacity giving a high quality of printed material.

A further object of the invention is to be able to use such a measure both in screen printing devices of which the printing belt drive device and the stencil drive means are mechanically coupled and where there is an electronic coupling between them.

These objects are attained according to the invention in a screen printing device comprising signal generation means which can produce a signal forming a measure for a displacement of the printing belt; one or more markings placed on or in the printing belt which can be detected by detectors securely fixed relative to the frame at predetermined intervals; comparison means for comparing the signal coming from the signal generation means, during a displacement of a marking on the printing belt from one detector to a next detector, with a predetermined reference signal; and correction means for adjusting the angle presetting of one or more stencils on the basis of the comparison result of the comparison means. A certain displacement of the printing belt in the device according to the invention is converted into a signal, preferably a number of pulses, by means of the signal generation means, preferably a pulse generator. If the distance between two successive detectors is selected as this displacement, then the number of pulses generated between the passage of a marking from one detector to the next detector must correspond to a number of pulses to be predetermined theoretically or in practice by means of a calibration measurement and generated during the displacement of the printing belt, which is checked by the comparison means. If the above two numbers of pulses are not the same, one or more of the above factors disturbing the register of the stencils at least in the region between the two successive detectors are obviously to blame. The deviation which has occurred is, however, known in number of pulses in the device according to the invention, which means that a stencil angle presetting correction can be carried out automatically.

A measure of the displacement of the printing belt can, on the one hand, be generated by the signal generation means themselves or, on the other hand, can be derived from the movement of the printing belt or devices directly or indirectly coupled to it.

In particular, if it is a screen printing device in which the printing belt drive device and the stencil drive means are mechanically coupled, but also in the case in which this coupling is provided electronically, it is advantageous to equip the signal generation means with a detector which is coupled to the printing belt, to a printing belt drive roller or to the first stencil, viewed in the direction of movement of the printing belt.

In the case of a screen printing device in which the belt drive device and the stencil drive means are coupled electronically, independent signal generation means providing a position setting signal for both the printing belt drive device and the stencil drive means can be used. This position setting signal is used, firstly, to achieve a synchronous running of the printing belt drive and the stencils and, secondly, can be used advantageously for continuous registering of the screen printing device according to the invention.

The detectors are preferably disposed near the stencils, with the number of stencils and the number of detectors being approximately equal. This means, for example, that a detector can be set up before each stencil, viewed in the direction of movement of the printing belt. The total number of detectors in this case is equal to the number of stencils. In this case, for example, the signal obtained when a marking passes from the first to the second detector, viewed in the direction of movement of the printing belt or the web of material, is used for checking the register of the second stencil, the signal obtained when a marking passes from the second to the third detector is used for checking the register of the third stencil, and so on. Of course, the angle presetting of the first stencil is not corrected, since the printed result on the web of material of the first stencil forms the starting point for the angle presetting of the other stencils The distance between the markings on the printing belt is in general determined by the detection accuracy of the detectors and the deviation which can develop within the interval between two markings. In a preferred embodiment the centre-to-centre distance between the markings is approximately equal to or smaller than the centre-to-centre distance between the stencils.

A particularly simple and reliable combination of marking and detector, a combination which is not affected by contamination occurring, is obtained if a marking is formed by a magnetic element, and each detector comprises a Hall probe.

In other preferred embodiments, markings are detected optically. In particular, a marking is formed here by a hole provided in the printing belt, and each detector comprises a light-sensitive element which is provided at one side of the printing belt along the path of the hole and is sensitive to light transmitted by a light source at the other side of the printing belt along the path of the hole. On the other hand, a marking can be formed by a vane which is fixed to the printing belt and can interrupt light coming from a light source and directed towards a light-sensitive element.

The claims and advantages will be more readily appreciated as the same becomes better understood by reference to the following detailed description and considered in connection with the accompanying drawings in which like reference symbols designate like parts with similar functions.

BRIEF DESCRIPTION OF THE DRAWINGS

FIG. 1 schematically shows a screen printing device according to the invention with an electronic coupling between the printing belt drive device and the stencil drive means, and which includes a block diagram for the control of the device;

FIGS. 2*a*–2*e* show time charts of signals occurring in the comparison means.

DESCRIPTION OF THE PREFERRED EMBODIMENTS

Figure 3:
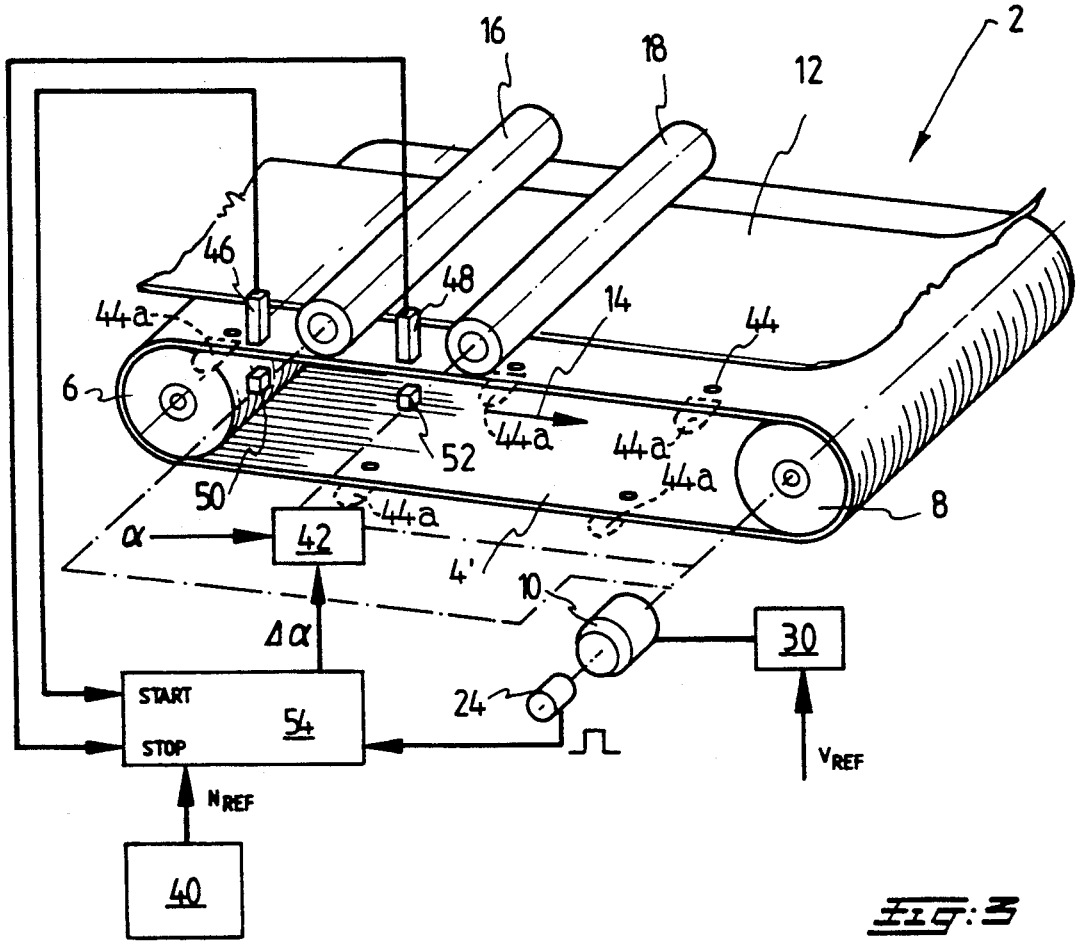
FIG. 3 schematically shows a screen printing device according to the invention with a mechanical coupling between the printing belt drive device and the stencil drive means, and which includes a block diagram for the control of the device.

FIG. 1 shows in perspective view a screen printing machine 2, comprising an endless printing belt 4 which is guided over two rollers 6 and 8 in a frame not shown in further detail. The roller 6 serves only to guide the printing belt 4, while the roller 8 serves to guide and drive the printing belt 4, and is driven by a suitable motor drive 10, for example an electric motor. The latter roller will therefore be described below as the printing belt drive roller 8. A web of material 12 is temporarily fixed, for example glued, on the top side of the printing belt 4, at the position of roller 6, so that the web of material 12 is carried along in the direction of arrow 14 when the printing belt 4 is moved over the rollers 6 and 8 by the motor drive 10. At the position of the printing belt drive roller 8 the web of material 12 is removed again from the printing belt 4 and conveyed in a known manner to a drier or the like. While the web of material 12 fixed on the printing belt 4 is passing through the screen printing machine 2, a pattern is printed on the top side of the web of material 12 by means of rotary stencils 16 and 18 also supported in the abovementioned frame. For this purpose, the stencils 16 and 18 are driven by respective motor drives 20 and 22, it being ensured that the peripheral speed of the stencils is in a fixed relation to the speed of the printing belt 4. This is achieved by coupling a pulse generator 24 to the motor drive 10 of the printing belt drive roller 8, and by feeding the pulses generated by it to control units 26 and 28 for the motor drives 20 and 22, respectively. In principle, this ensures a synchronous running of the printing belt 4 and the stencils 16 and 18. For the pattern produced on the web of material 12 by the stencil 18 to be in register with the pattern applied by the stencil 16 on the web of material 12, the angle position $\alpha$ of the stencil 18 is preset relative to a reference angle position of the stencil 16.

The printing speed of the screen printing device 2 is determined by feeding a speed reference signal $V_{REF}$ to a control unit 30 for the motor drive 10.

The printing belt 4 is provided with a number of markings in it in the form of magnetic elements 32 which are provided, for example, at regular intervals; however, in general the intervals need by no means be regular. Disposed above the path of the markings 32 in the printing belt 4, before each stencil 16, 18, viewed in the direction of movement 14 of the printing belt 4, is a detector 34, 36 respectively, each provided with a Hall probe. When a marking 32 passes a detector, it produces in said detector a signal which is fed to a comparison unit 38. The signal generated by the pulse generator 24 is also fed to comparison unit 38, as is a reference signal coming from a memory 40, which forms a measure for the number of pulses $N_{REF}$—determined theoretically or in practice by a calibration measurement—to be received by comparison unit 38 from pulse generator 24 while a marking 32 is passing from detector 34 to detector 36. Therefore, as FIG. 2*a* shows, when a marking 32 passes, detector 34 always produces a starting signal for counting the pulses coming from pulse generator 24. Some time later, the abovementioned marking then passes detector 36, and the latter produces a stop signal, as is shown in FIG. 2*b*. This stops the counting of the pulses coming from the pulse generator 24. The number of pulses thus determined is compared in the comparison unit 38 with the number of pulses $N_{REF}$ fed in by memory 40.

The way in which this takes place is illustrated by FIGS. 2c and 2d. After a delay time $T_D$ following receipt of a stop signal from detector 36, a load signal according to FIG. 2c ensures that the value $N_{REF}$ is loaded from the memory 40 into the comparison unit 38, as FIG. 2d shows. After receipt of a starting signal coming from the detector 34 in the comparison unit 38, the number of pulses received from the pulse generator 24 is subtracted from the number of pulses $N_{REF}$ present in the comparison unit until a stop signal is received from the detector 36. If the number of pulses $N_{REF}$ minus the number of pulses received from the pulse generator 24 equals zero at that moment, the actual displacement of a marking 32 between the detectors 34 and 36 equals the displacement determined theoretically or by means of a calibration measurement, and consequently the correction of the angle presetting $\alpha$ of the stencil 18 is zero. If the above-mentioned difference deviates in the positive or negative sense from the zero level, a proportional angle presetting correction signal $\Delta\alpha$, illustrated in FIG. 2e, is fed to the control unit 28 of the motor drive 22 of the stencil 18, as a result of which the register of the stencils 16 and 18 is automatically corrected for the error occurring.

FIG. 3 shows a screen printing device of which the motor drive 10 of the printing belt drive roller 8 and the stencils 16 and 18 are mechanically coupled. An adjustable coupling 42 is included in the mechanical coupling to the stencil 18, by which the angle $\alpha$ can be preset relative to that of the stencil 16.

The printing belt 4' is provided along one of its edges with through holes 44 lying at intervals from each other, while on either side of the printing belt 4', along the path of the holes 44, light-sensitive detectors 46 and 48 and light sources 50 and 52, respectively, are placed. When a hole 44 in the printing belt 4' passes, the detectors 46 and 48 provide a start signal and stop signal, respectively, to a comparison unit 54. The comparison unit 54 then produces an angle presetting correction signal $\Delta\alpha$ on the basis of the detector signals, in the way already described for comparison unit 38 of FIG. 1 and the corresponding FIGS. 2a–2e, for the automatic correction of any stencil register error occurring.

It will be clear that the registering of more than the two stencils shown in FIGS. 1 and 3 can take place entirely analogously to the way as that described. It is also possible either to have a start and stop signal generated at a certain position relative to a stencil by one detector, or to use two different detectors for these two functions.

FIG. 3 also illustrates a further embodiment of the present invention, wherein a plurality of vanes, as illustrated in dashed lines at 44a, are utilized as an alternative to the holes 44. The vanes 44a may be mounted in spaced apart relation along one edge of the belt and so as to interrupt light coming from the light source 50, 52 toward its associated light sensitive element 46, 48.

While the invention has been described and illustrated in its preferred embodiments, it should be understood that departures may be made therefrom within the scope and spirit of the invention, which is not limited to the details disclosed herein.

What is claimed is:

1. A screen printing apparatus for printing a web of material, comprising an endless belt, means including a plurality of rollers mounting said endless belt for movement along an endless path of travel, belt drive means coupled to at least one of said roller for driving said belt along said endless path of travel, a plurality of stencils rotatably mounted about fixed axes which extend transversely to said direction of movement, and so that each stencil is adapted to apply a printed pattern to a web of material which moves with said belt and between said belt and said stencils, stencil drive means coupled to each of said stencils for rotatably driving the same, means coupling said belt drive means and said stencil drive means so as to maintain a predetermined speed relationship therebetween, and with each of said stencils having a predetermined angular orientation with respect to the other stencils so that the printed patterns are printed in registry on the web of material, at least one indicium positioned on or in said belt, signal generation means for producing a signal representative of a displacement of said belt, detector means comprising a plurality of detectors fixedly mounted with respect to said screen printing apparatus for detecting the displacement of said at least one indicium from one detector to a next detector, comparison means for comparing the signal from said signal generation means, during a displacement of said at least one indicium from said one detector to said next detector, with a predetermined reference signal, and for generating a correction signal representative of any difference therebetween, and correction means for adjusting the angular orientation of at least one of said stencils with respect to the angular orientation of at least one other of said stencils in response to said correction signal and so as to maintain the registry of the printed pattern of the web of material under varying operating conditions.

2. The screen printing apparatus as defined in claim 1 wherein said signal generation means comprises a signal generator which generates a signal composed of pulses, and wherein said comparison means counts the pulses and compares the sum with a predetermined number of pulses supplied by said predetermined reference signal.

3. The screen printing apparatus as defined in claim 1 wherein said signal generation means comprises a signal generator which is coupled to one of said endless belt, said at least one of said rollers, and the first of said stencils when viewed in the direction of movement of said endless belt.

4. The screen printing apparatus as defined in claim 1 wherein said signal generation means comprises a signal generator which provides a position setting signal for said belt drive means and said stencil drive means.

5. The screen printing apparatus as defined in claim 1 wherein the number of said stencils and the number of said detectors are approximately the same, and wherein said detectors are disposed adjacent respective ones of said stencils.

6. The screen printing apparatus as defined in claim 1 wherein said at least one indicium comprises at least two indicia positioned on or in said belt at spaced apart locations, and wherein the center-to-center distance of said at least two indicia is approximately equal to or smaller than the center-to-center distance of said stencils.

7. The screen printing apparatus as defined in claim 1 wherein said at least one indicium comprises a plurality of magnetic elements mounted on said belt at spaced apart locations, and each of said plurality of detectors comprises a Hall probe.

8. The screen printing apparatus as defined in claim 1 wherein said at least one indicium comprises a plurality of holes in said belt at spaced apart locations, and each of said plurality of detectors comprises a light emitting element mounted on one side of said belt and a light sensitive element mounted on the other side of said belt, with each of said detectors being positioned so that said holes pass between the associated light emitting element and light sensitive element during movement of said belt along said endless path of travel.

9. The screen printing apparatus as defined in claim 1 wherein said at least one indicium comprises a plurality of vanes mounted to said endless belt at spaced apart locations, and each of said plurality of detectors comprises a light emitting element mounted on one side of said belt and a light sensitive element mounted on the other side of said belt, with each of said detectors being positioned so that said vanes pass between the associated light emitting element and light sensitive element during movement of said belt along said endless path of travel.

* * * * *